United States Patent [19]

Neitzel et al.

[11] 4,373,509

[45] Feb. 15, 1983

[54] HIGH EFFICIENCY VENTILATION SYSTEM

[75] Inventors: Emery W. Neitzel, Rothschild; Jerome A. Schumacher, Wausau, both of Wis.

[73] Assignee: Greenheck Fan Corporation, Schofield, Wis.

[21] Appl. No.: 198,588

[22] Filed: Oct. 20, 1980

[51] Int. Cl.[3] ..... F21C 15/08; F23J 11/00

[52] U.S. Cl. ..... 126/299 D; 55/DIG. 36

[58] Field of Search ..... 126/299 R, 299 D, 299 E, 126/312; 98/41 R; 55/DIG. 36

[56] References Cited

U.S. PATENT DOCUMENTS

| | | | |
|---|---|---|---|
| 3,260,189 | 7/1981 | Jensen | 98/115 |
| 3,292,525 | 12/1966 | Jensen | 98/115 |
| 3,386,365 | 6/1968 | Jensen | 98/36 |
| 3,400,649 | 9/1968 | Jensen | 98/115 |
| 3,457,850 | 7/1969 | Sweet et al. | 98/115 |
| 3,616,744 | 11/1971 | Jensen | 98/115 K |
| 3,978,777 | 9/1976 | Nett | 98/115 K |
| 3,980,072 | 9/1976 | Jacobs | 126/299 D |
| 4,129,121 | 12/1978 | Dorius | 126/299 D |
| 4,134,394 | 1/1979 | Otenbaker | 126/299 D |
| 4,155,348 | 5/1979 | Ahlrich | 126/299 D |
| 4,175,614 | 11/1979 | Huggins | 126/299 D |

*Primary Examiner*—James C. Yeung

*Attorney, Agent, or Firm*—Quarles & Brady

[57] ABSTRACT

A ventilation system for institutional and commercial cooking equipment includes a hood which is placed over the equipment and which attaches to an exhaust duct and fan that removes a relatively constant volume of air from beneath the hood. A make-up air supply divides to form a fresh air duct that connects to the hood and a tempered air duct which also connects to the hood. The fresh air is directed beneath the hood by fresh air registers and the tempered air is directed into the surrounding room by tempered air registers. The relative amounts of fresh air and tempered air can be changed by a damper, but the damper does not significantly alter the total amount of supplied make-up air. The system can thus be adjusted to use more or less tempered air as various combinations of cooking equipment are used without affecting the overall balance of exhaust air and make-up air.

9 Claims, 4 Drawing Figures

HIGH EFFICIENCY VENTILATION SYSTEM

BACKGROUND OF THE INVENTION

The field of the invention is ventilation systems for use with institutional and commercial cooking equipment.

Kitchen hoods can be categorized into two types, compensating and non-compensating. The non-compensating hood includes an exhaust system which draws contaminated air from above the cooking equipment and carries it through ductwork to the outside. Make-up air is supplied to the kitchen from a separate source such as the building's heating or cooling plant. A compensating hood, on the other hand, has an integral air supply system which introduces the proper amount of make-up air into the kitchen. Although compensating hoods are more complex, and hence more expensive, the make-up air can be carefully controlled on such hoods to insure proper operation of the ventilation system.

Of course the primary objective of kitchen hood design is to effectively exhaust contaminants generated by the cooking equipment. An objective of ever-increasing importance in recent years is the efficiency with which the hood performs this function. In each of these designs (compensating or non-compensating) make-up air must be introduced into the kitchen to replace that being exhausted, and at extreme outside temperatures, this make-up air must be heated or cooled to acceptable levels. The heating or cooling of this make-up air is becoming more expensive due to the rapidly escalating energy costs.

There are numerous guidelines and codes which apply to the design of kitchen ventilation systems, and in most installations these codes require that a specified minimum amount of air be exhausted. This specified amount may be determined by the type and size of cooking equipment beneath the hood or by the area which the hood covers. In all cases the amounts specified are intended to deal with worst case situations which seldom occur in practice. As a result, the ventilation system is required to exhaust and to supply make-up air in quantities far in excess of that actually needed to exhaust contaminants and odors. In addition, these specified amounts of air must be maintained even though not all of the cooking equipment beneath the hood is in operation.

Efficiency of kitchen ventilation systems can be increased greatly by entering fresh outside air as part or all of the make-up air. As disclosed in U.S. Pat. No. 4,134,394 for example, make-up air is supplied from one source which provides fresh air from outside the building and a second source which provides conditioned, or "tempered" air. The outside fresh make-up air is not directed into the kitchen area, but is instead directed beneath the hood. This practice maintains the amount of exhaust air required by applicable codes and reduces the tempered air removed from the kitchen. Since the tempered make-up air may only comprise a percentage of the total make-up air (depending upon the cooking equipment beneath the hood), a considerable energy savings is achieved over non-compensating hoods which require one hundred percent tempered or conditioned make-up air.

Although prior overhead canopy kitchen hoods provide means for reducing the amount of tempered make-up air while maintaining the total amounts of exhaust air required by applicable codes, none provides means for further reducing the amount of tempered make-up air when less than all of the cooking equipment is in operation. In an installation containing an oven, fryer, range and charbroiler, for example, the following amounts of exhaust air may be needed for adequate ventilation:

Oven—375 cubic feet/minute
Fryer—255 cubic feet/minute
Charbroiler—1133 cubic feet/minute
Range—496 cubic feet/minute The kitchen hood is sized and the ratio of fresh make-up air to tempered make-up air is set to handle the total ventilation load, which in this example is 2259 cubic feet of tempered air per minute. If the user operates only the oven, as is typical in institutions which do their own baking, a total of 1884 cubic feet per minute of tempered air is exhausted unnecessarily. Indeed, considerable energy is wasted through the exhaust system when all but the charbroiler are operational and in many installations the charbroiler may only be operated for short periods of time just prior to meals. In other words, prior kitchen ventilation systems waste considerable amounts of costly energy when all of the cooking equipment is not in operation.

SUMMARY OF THE INVENTION

The present invention is a ventilation system in which the amount of supplied tempered make-up air can be adjusted by the user to meet the exhaust load of the cooking equipment without affecting the total supply of make-up air of the total amount of air being exhausted. More specifically, the invention includes a make-up air supply system which provides a selected volume of fresh air to a fresh air duct and a tempered air duct, a means for conditioning the air flowing through the tempered air duct, a hood for mounting over the cooking equipment, a fresh air register coupled to the fresh air duct, a tempered air register coupled to the tempered air duct, and means for changing the relative amounts of air flowing through the registers without changing the total combined air flow through the two registers. If a particular piece of cooking equipment is not in use, the portion of the hood over this equipment is adjusted to cut off or reduce the flow of tempered air and increase by a corresponding amount the flow of fresh untempered air. The fresh air is directed beneath the hood to reduce the amount of costly tempered air removed from the kitchen and does not affect room temperature. The total volume of make-up air and exhaust air remains unaffected by the change.

A general object of the invention is to increase the operating efficiency of ventilation systems used with institutional and commercial cooking equipment. By dividing the hood into separately adjustable modules, each can be set to produce only the amount of tempered air required to exhaust the cooking equipment beneath it. Thus the total amount of tempered air supplied is determined by the amount of cooking equipment in use rather than a fixed amount based on worst case conditions when all the cooking equipment is operational.

Another object of the invention is to provide a ventilation system which maintains a relatively constant supply of make-up air. A single air intake fan supplies a preselected amount of outside air to the fresh air and tempered air ducts. Although the amount of air flowing in either duct is altered when the registers are adjusted, the total volume of make-up air flowing through the ducts remains relatively constant. Thus, although the amount of supplied tempered air can be changed to meet various operating conditions, the correct amount of make-up air remains constant and the amount of exhaust air flow required is thus assured. These factors are important to maintain an overall balanced system and to insure maximum extraction of grease by the filters provided in the hood. An unbalanced system can cause problems due to smoke, heat, odors or it can adversely affect the performance of cooking equipment.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
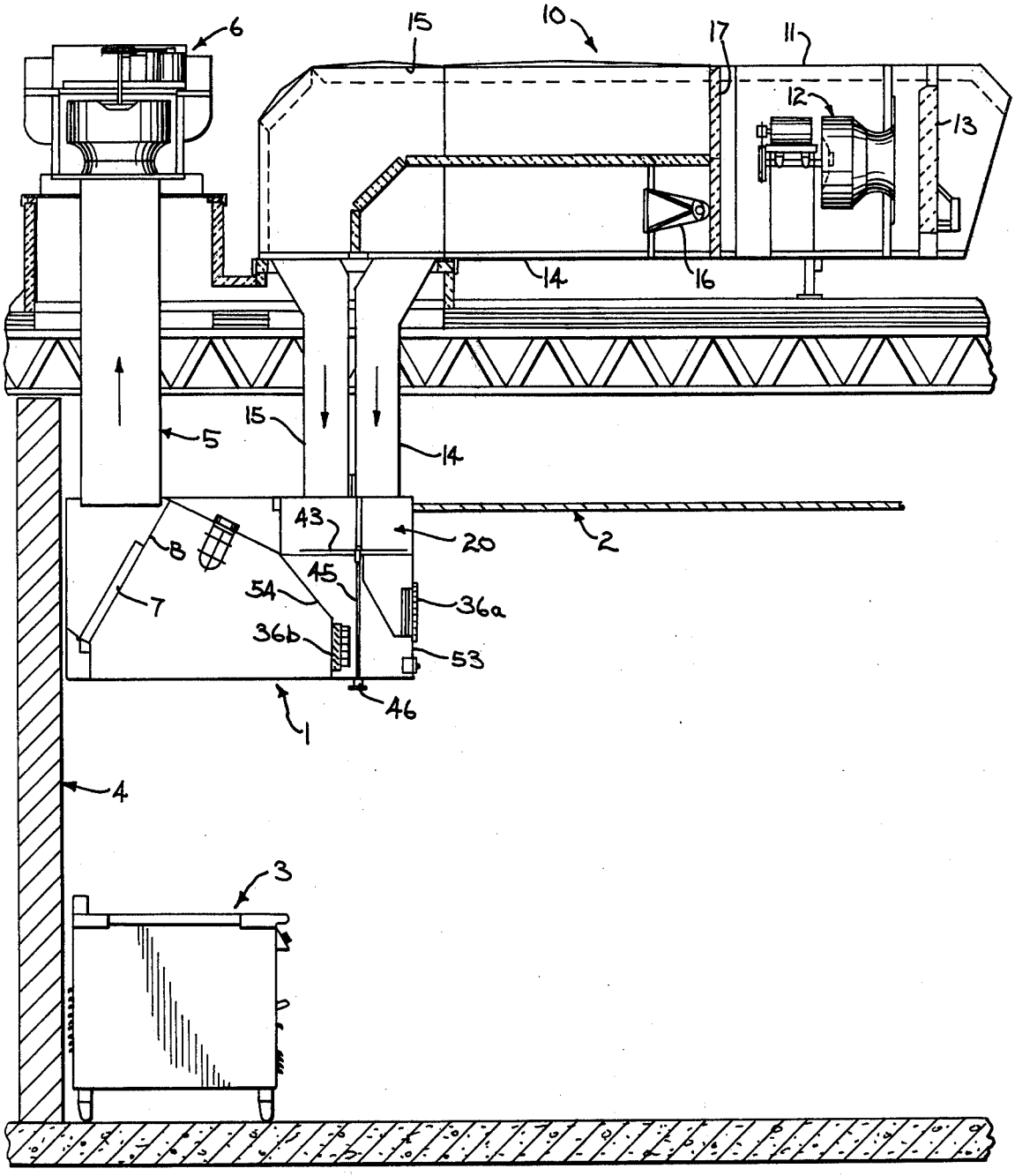
FIG. 1 is a side view in cross section of the ventilation system of the present invention.

Referring particularly to FIG. 1, a ventilation system according to the present invention includes a hood 1 which is mounted at the ceiling 2 above cooking equipment 3. A wall canopy version is shown in which the cooking equipment 3 and hood 1 are positioned against a wall 4, although the same equipment can be employed in a single, double island or other kitchen ventilator configurations as well.

The hood 1 forms a canopy over the cooking equipment 3 and it connects to an exhaust duct 5 which extends upward through the ceiling 2 to an exhaust fan 6 mounted on the roof. Grease filters 7 are mounted in a filter rack 8 of the hood 1 and the exhaust fan 6 draws air from beneath the hood 1 through these filters 7 and up the exhaust duct 5 at a specified velocity. The amount of air exhausted by the fan 6 is calculated to meet the requirements of the applicable codes and is nearly always greater than the amount actually required to remove contaminants and odors generated by the cooking equipment 3.

Also mounted on the roof is a make-up air supply system 10 which includes an inlet duct portion 11 that contains an air intake fan 12. Outside air is drawn into the inlet duct 11 through a motorized damper 13 by the fan 12 and it is delivered to either a tempered air duct 14 or a fresh air duct 15 through the air diffuser and filters 17. Although the relative amounts of air delivered to the ducts 14 and 15 can be changed according to the present invention, the total intake air delivered by the fan 12 remains relatively constant. Thus the ventilation system can be balanced rather easily with the intake fan 12 being sized to deliver slightly less make-up air than the fan 6 exhausts. The remainder of the make-up air is typically provided from registers located outside the kitchen (not shown in the drawings) to establish an air flow into the kitchen which prevents the escape of cooking odors.

Mounted within the tempered air duct 14 is a gas heating element 16. The heating element 16 is controlled by a thermostatic element (not shown in the drawings) which is mounted in the tempered air duct 14 and which operates to maintain the temperature of the air flowing therethrough within a preselected range. It should be apparent that other types of heating elements and controls can be employed to warm the intake air in duct 14 when the ventilation system is used in cold climates. Also, the heating unit 16 can be replaced by air conditioning cooling coils when the system is used in warm climates. In other words, any suitable means for conditioning the intake air to "temper" it may be employed. It is a major objective of the present invention that this device consume the minimal amount of energy required under all operating conditions.

Figure 2:
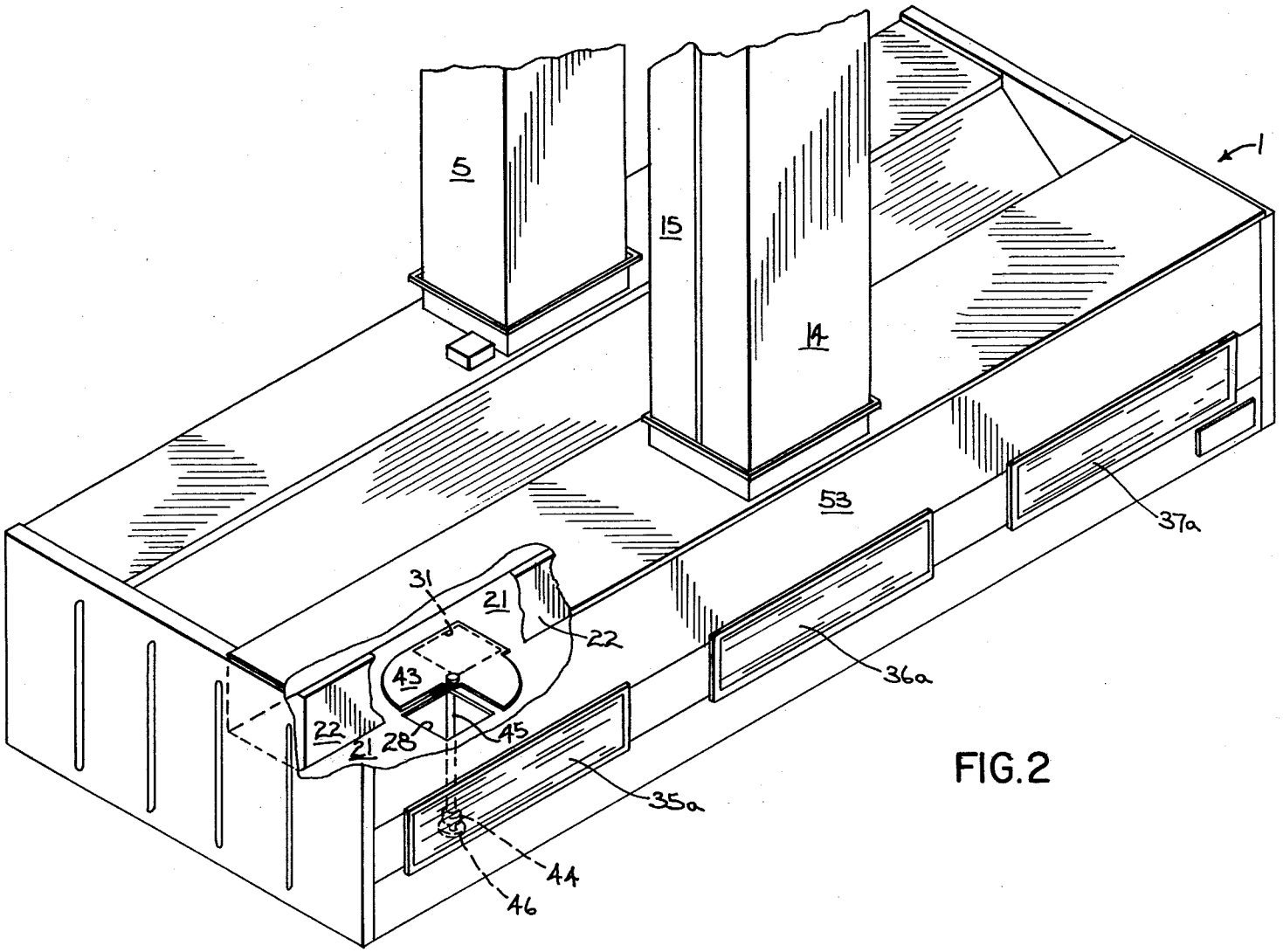
FIG. 2 is a perspective view with parts cut away of the hood which forms part of the system of FIG. 1.
Figure 3:
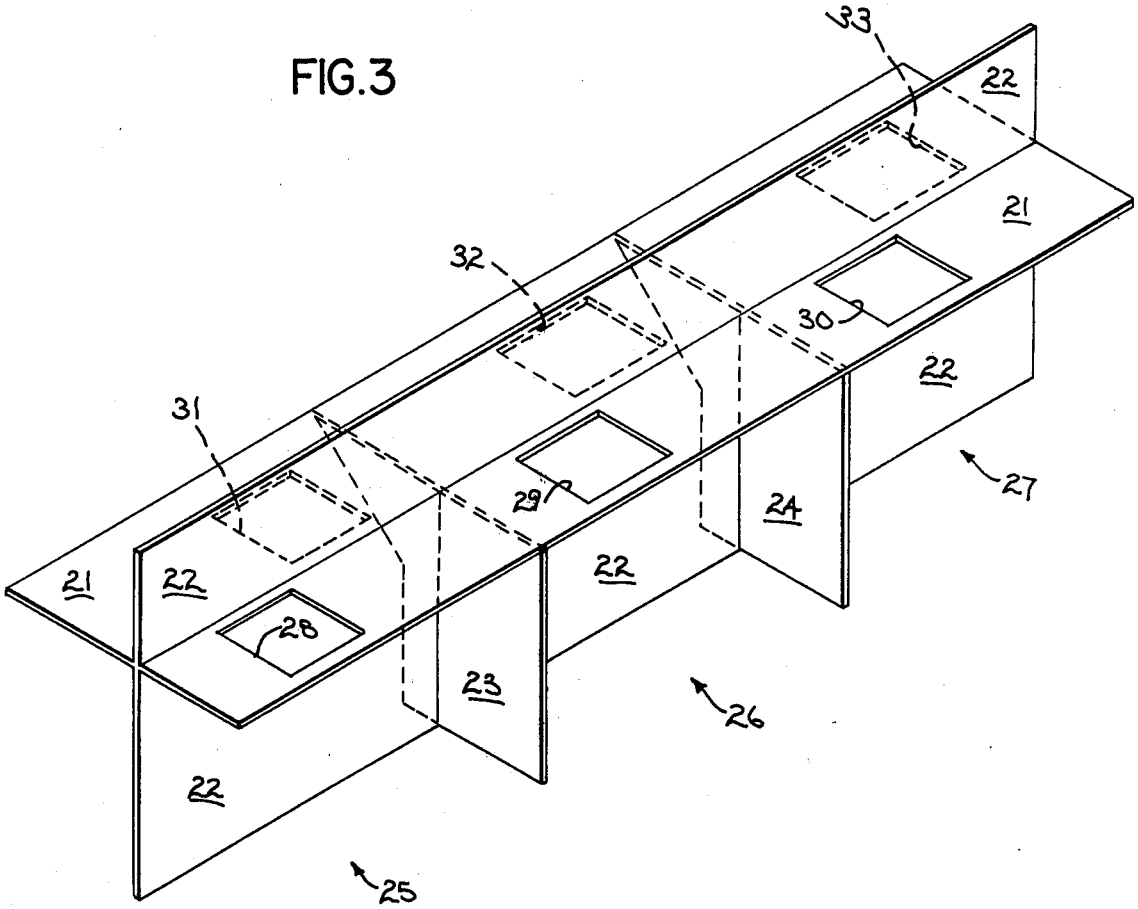
FIG. 3 is a perspective view of the partitions within the hood of FIG. 2.

Referring particularly to FIGS. 1–3, the hood 1 is constructed of sheet metal which is formed to define an air plenum 20 that extends along the entire lateral extent of the hood 1 and which connects to the fresh air duct 15 and the tempered air duct 14. As shown best in FIG. 3, the plenum 20 is divided into chambers by sheet metal partitions which include a horizontally disposed base partition 21 and a vertically disposed divider partition 22. The divider partition 22 separates the plenum 20 into a tempered air portion located forward of the partition 22 and a fresh air portion located to the rear. A pair of upright walls 23 and 24 further divide the plenum 20 into three modules indicated generally at 25, 26 and 27. The modules 25, 26 and 27 extend across the lateral extent of the hood 1 and the number and size of these modules can be varied depending on the size of the hood 1 and the number of cooking apparatuses positioned beneath the hood 1.

The tempered air portion of the plenum 20 communicates with the tempered air duct 14 and the fresh air portion communicates with the fresh air duct 15. Three tempered air inlets 28–30 are formed in the base partition 21, forward of the divider partition 22 and three corresponding fresh air inlets 31–33 are formed to the rear of the divider partition 22. The inlets 28 and 31 form a pair which is associated with the module 25, the inlets 29 and 32 form a pair which is associated with module 26 and the inlets 30 and 33 form a pair which is associated with module 27.

As shown best in FIGS. 1 and 2, the modules 25–27 also include tempered air registers 35*a*–37*a* which are disposed along the front face 53 of the hood 1. They are associated with corresponding fresh air registers 35*b*–37*b* which are disposed along a back face 54 of the hood 1 and which are directed rearward beneath the hood 1. Tempered air flows to each register 35*a*–37*a* through respective tempered air inlets 28–30 and fresh air flows to each register 35*b*–37*b* through respective fresh air inlets 31–33. As with the inlets, the registers form register pairs 35*a* and 35*b*, 36*a* and 36*b*, and 37*a* and 37*b*. Tempered air is directed out the registers 35*a*–37*a* into the kitchen to replace room air which is exhausted, whereas the fresh air flowing through registers 35*b*–37*b* is directed rearward, beneath the hood 1 where it is promptly drawn through the grease filter 7 and up the exhaust duct 5. This fresh make-up air contributes to the volume of air exhausted up the duct 5 without circulating through the kitchen and affecting room temperature. It is a teaching of the present invention that a minimal amount of tempered air determined by the amount of operating cooking equipment beneath the hood be provided through the registers 35*a*–37*a*, and that the balance of the required air flow through the exhaust duct 5 be made up of "short-circuit" fresh air provided through the registers 35*b*–37*b*.

Control of the relative air flow through each of the register pairs is achieved by operable dampers 43. As shown best in FIGS. 2 and 4, each damper assembly includes a damper blade 43 which is rotatably mounted to the base partition 21 by a bushing 44 and a control rod 45. The damper blade 43 is securely attached to the control rod 45 and the dampers 43 are positioned over the respective air inlet pairs. They may be separately rotated between a first position in which they completely cover the fresh air inlets 31–33 and a second position in which they completely cover the tempered air inlets 28–30. Each control rod 45 extends downward beneath the hood 1 where it is terminated with a knob 46 which is accessible to the user. The user can separately adjust the dampers 43 in each module 25–27 by rotating the knob 46.

Figure 4:
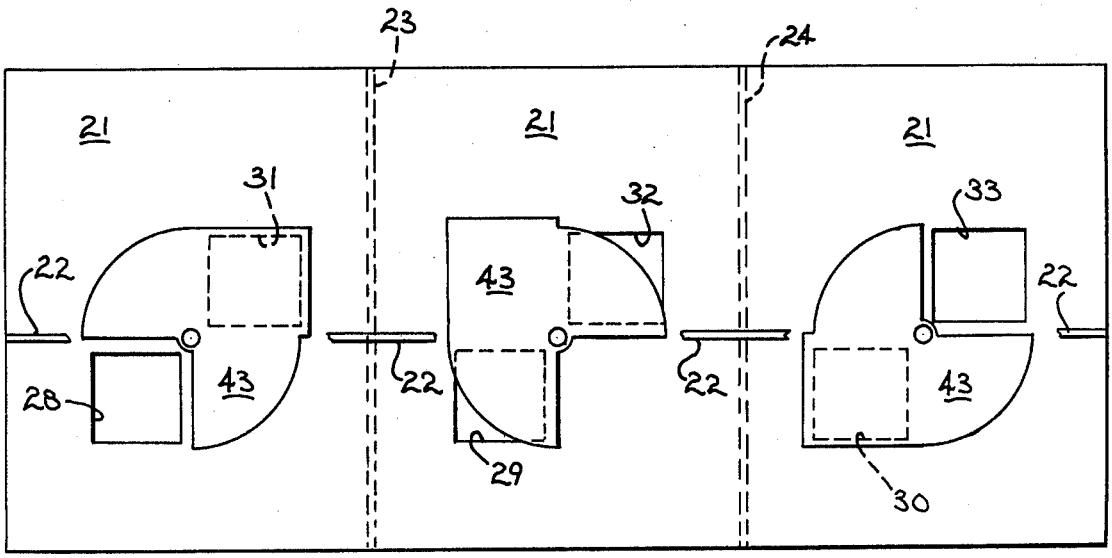
FIG. 4 is a top view of the hood of FIG. 2 with parts cut away to show the dampers which form part of the hood of FIG. 2.

As shown in FIG. 4 for example, the damper blade 43 associated with inlet pair 28 and 31 is shown in its first position in which the fresh air inlet 31, and hence the fresh air register 35*b*, is completely blocked. When rotated 180 degrees, however, the damper blade 43 is in its second position in which it completely blocks the tempered air inlet and associated register. This latter situation is illustrated in FIG. 4 by the damper blade 43 and air inlet pair 30 and 33 in module 27. In between these two extreme damper positions is a continuum of positions in which the damper blade 43 partially blocks both air inlets of its associated pair. This is illustrated by the middle damper in FIG. 4 in which the damper blade 43 is at an intermediate orientation covering portions of both air inlets 29 and 32.

As shown best in FIG. 4, the damper blades 43 are contoured such that regardless of the position of the dampers 43, the total make-up air supplied by the fan 12 remains substantially constant. For example, when some of the cooking equipment is not operational, the damper in the module above that equipment may be rotated to block the tempered air inlet and divert more make-up air to the fresh air duct 15. This additional fresh air flows through the fresh air inlet and fresh air register where it is directed beneath the hood 1 and up the exhaust duct 5. The air flow in the tempered air duct 14 is reduced by a corresponding amount and the heating element 16 operates less often to maintain the tempered air at a comfortable temperature. Thus, although the relative amounts of make-up air through the fresh air registers 35*b*–37*b* and tempered air registers 35*a*–37*a* may be changed by rotating the dampers 43, the total amount of make-up air remains unchanged and in balance with the volume of air being exhausted.

We claim:

1. A ventilation system for a room which comprises:

a make-up air supply system including an inlet duct, a fan for supplying a substantially constant volume of fresh air to the inlet duct, a tempered air duct connected to the inlet duct and including means for conditioning air flowing therethrough, and a fresh air duct connected to the inlet duct;

a hood disposed within the room and having a fresh air register coupled to the fresh air duct and positioned to direct fresh air beneath the hood and having a tempered air register coupled to the tempered air duct and positioned to direct tempered air into the room, the hood also including damper means for changing the relative amounts of air flowing through the tempered air register and the fresh air register without changing the combined amount of air flowing through both of said registers; and an exhaust system having an exhaust duct coupled to the hood and an exhaust fan for withdrawing a substantially constant amount of air from beneath the hood through the exhaust duct.

2. The ventilation system as recited in claim 1 in which the damper means is operable between a first position in which air flow through the fresh air register is blocked and a second position in which air flow through the tempered air register is blocked.

3. The ventilation system as recited in claim 2 in which the damper means includes a rotatably mounted damper blade aligned to block air flow through the fresh air register when rotated to the first position and aligned to block air flow through the tempered air register when rotated to the second position, and a rod connected to the damper blade and extending downward therefrom to a position which is accessible from beneath the hood.

4. A ventilation system for equipment which comprises:

a hood mounted above the equipment, the hood including a fresh air plenum which extends laterally substantially across the entire width of the hood and which connects to a source of fresh air, a tempered air plenum which extends laterally substantially across the entire width of the hood and which connects to a source of tempered air;

a set of tempered air registers disposed across the width of the hood and positioned to direct tempered air from the tempered air plenum into the air space surrounding the equipment;

a set of fresh air registers disposed across the width of the hood and positioned to direct fresh air from the fresh air plenum beneath the hood;

damper means mounted to the hood and being operable to change the relative amounts of air flowing through the tempered air registers and the fresh air registers without changing the combined amount of air flowing through all of said registers; and an exhaust duct coupled to the hood to exhaust air from beneath the hood.

5. The ventilation system as recited in claim 4 in which each of said fresh air registers is associated with a corresponding one of the tempered air registers to form register pairs, and said damper means includes a set of separately operable damper blades, one damper blade associated with each register pair, wherein the damper blades may each be operated to adjust the relative amounts of air flowing through the two registers in its register pair without affecting the combined amount of air flowing through its register pair.

6. The ventilation system as recited in claim 5 in which said fresh air plenum and said tempered air plenum are divided into modules by walls and a register pair is disposed in each of said modules.

7. The ventilation system as recited in claim 4 in which said fresh air source and said tempered air source emanate from a common inlet duct and an air intake fan is disposed in said inlet duct to provide a preselected and relatively constant supply of air.

8. The ventilation system as recited in claim 7 in which an exhaust fan is coupled to said exhaust duct to extract a relatively constant volume of air from beneath the hood, wherein the size of the exhaust fan is selected to extract the same or more air as that supplied by the air intake fan.

9. A ventilation system for a room, the combination comprising:

a make-up air supply system including an inlet duct, a fan for supplying a selected volume of fresh air to the inlet duct, a tempered air duct connected to the inlet duct and including means for conditioning the air flowing therethrough, and a fresh air duct connected to the inlet duct;

a hood having a plurality of modules positioned side-by-side across the lateral extent of the hood, each module having a fresh air register coupled to the fresh air duct and positioned to direct fresh air beneath the hood, each module having a tempered air register coupled to the tempered air duct and positioned to direct tempered air into the room, and each module including means for changing the relative amounts of air flowing through its tempered air register and its fresh air register without changing the combined amount of air flowing through the tempered air register and the fresh air register; and an exhaust system having an exhaust duct coupled to the hood and an exhaust fan for withdrawing a selected amount of air from beneath the hood through the exhaust duct.

* * * * *